United States Patent [19]

Turnidge et al.

[11] Patent Number: 4,957,296

[45] Date of Patent: Sep. 18, 1990

[54] GOLF BALL DISPENSER AND TEEING DEVICE

[75] Inventors: Howard M. Turnidge, Sacramento; Theodore Talvan, Redlands, both of Calif.

[73] Assignee: Howco Trust

[21] Appl. No.: 31,563

[22] Filed: Mar. 30, 1987

Related U.S. Application Data

[63] Continuation-in-part of Ser. No. 746,129, Jun. 18, 1985, abandoned.

[51] Int. Cl.[5] ..... A63B 69/00

[52] U.S. Cl. ..... 273/201

[58] Field of Search ..... 273/201, 202, 33, 182 R, 273/191 R

[56] References Cited

U.S. PATENT DOCUMENTS

| | | | |
|---|---|---|---|
| 2,071,356 | 2/1937 | Pagett | 273/201 |
| 2,390,998 | 12/1945 | Gale | 273/201 |
| 2,883,313 | 6/1958 | Mozel | 273/201 |
| 3,171,299 | 8/1939 | Beckett | 273/201 |
| 3,756,606 | 9/1973 | Land | 273/201 |
| 3,758,118 | 9/1973 | Willcox | 273/201 |
| 4,146,232 | 3/1979 | Stone | 273/201 |
| 4,177,996 | 12/1979 | Chang | 273/201 |
| 4,360,204 | 11/1982 | Karr | 273/201 |
| 4,441,717 | 4/1984 | Willcox | 273/201 |
| 4,796,893 | 1/1989 | Chio | 273/201 |

FOREIGN PATENT DOCUMENTS

| | | | |
|---|---|---|---|
| 574237 | 3/1933 | Fed. Rep. of Germany | 273/201 |
| 1236751 | 6/1971 | United Kingdom | 273/201 |

OTHER PUBLICATIONS

"PracTees Makes Golf Practice 60 Times Easier", Sharper Image Catalog, p. 23, Jul., 1989.

*Primary Examiner*—T. Brown

*Attorney, Agent, or Firm*—D. Pressman

[57] ABSTRACT

An improved golf ball teeing device provides a method and apparatus for conveniently and automatically positioning golf balls on a tee (38) so they can be hit by a golf club in the hands of a golfer. The golfer can activate the entire operation with a golf club from an upright position or stance. Upon activation of the golf ball release and transfer assembly, a golf ball from a single line of golf balls supplied by a golf ball dispenser follows a path from golf ball receiver (60) to a downward sloping guide track (36) and a runner provided by the two side arms of a pivot arm assembly (43 and 49) where the golf ball is centered upon a tee (38). A spring (51) provides tension on the pivot arm assembly. The teeing device is designed for use with two different sizes of mats with fixed tees. Both of these mats (39 and 81) have an opening which allows the teeing device to be so positioned within the opening at the outer end of the pivot arm assembly (43 and 49) that the tee (38) will be properly aligned. One of these mats is small for portability, while the other is much larger to enable the golfer to stand upon the mat while hitting golf balls in practice sessions.

7 Claims, 7 Drawing Sheets

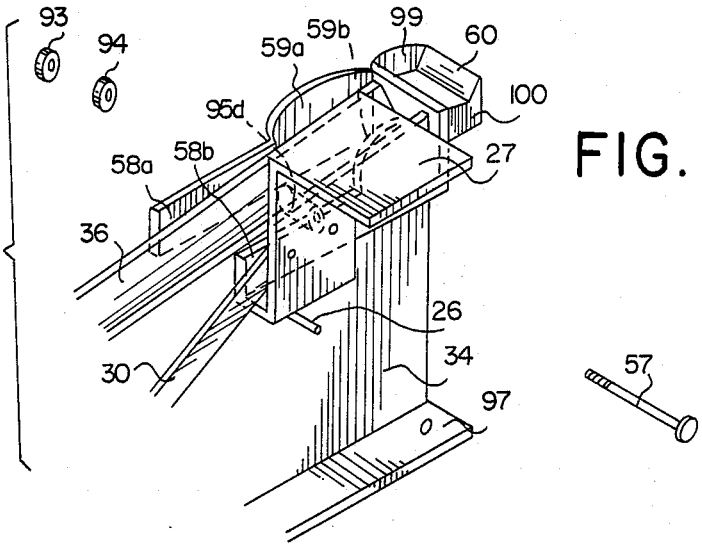
FIG. 3
FIG. 8
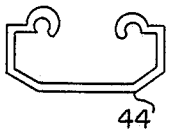
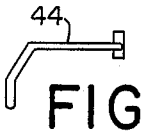
FIG. 9
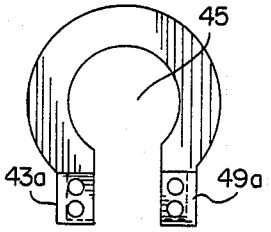
FIG. 4
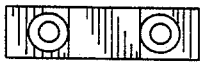
FIG. 5
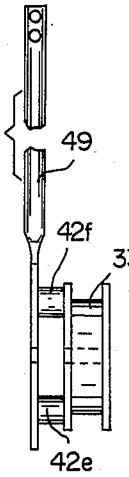
FIG. 6
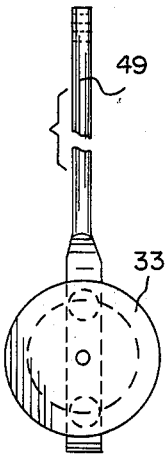
FIG. 7

GOLF BALL DISPENSER AND TEEING DEVICE

CROSS REFERENCE TO RELATED APPLICATION

This application is a continuation-in-part application of parent application Ser. No. 746,129, filed 1985/06/18, now abandoned.

FIELD OF INVENTION

This invention relates to golf, particularly to a device for positioning golf balls for play.

A design patent application Ser. No. 656,256, filed 1984/09/28, and titled "Golf Ball Dispensor", relates to the outer appearance of a golf ball dispenser suitable for use with this invention.

DISCUSSION OF PRIOR ART

Heretofore golf ball teeing devices and dispensers have been provided for use by golfers who desired to practice from fixed teeing locations to improve their golfing skills. One such device was designed with a circular housing containing a spiral track or tube to feed golf balls to a teeing device in single file. Another golf ball dispenser had a platform placed in the ground so that its top surface was flush with the ground, and all feed mechanisms were below ground. Several such devices have used actuating mechanisms which were attached to tees connected to springs, levers, counterweights, and pivoted platforms. However, they all suffered from a number of important disadvantages. A multitude of mechanisms and installation requirements led to complex operations.

There are a number of golf ball dispensers attached to teeing devices, but none of these are designed to operate as an independent dispenser such as the present invention. Helical golf ball dispensers are common in conjunction with teeing devices. Coin operated golf ball dispensers are currently being used at golf ball driving ranges.

Currently it has been noted that there are three different types of golf ball dispensers and teeing devices being advertised in golf catalogues, and some of these have been designed for golf ball driving ranges. Other such devices have been patented, but few have made it into the market place.

Prior art references do not show or suggest a golf ball dispenser operating independently of a teeing device and employing a container having facing side walls, each with two portions, one facing the corresponding other portion and rising perpendicularly from a base, the other portion narrowing to the other at an exit end of the base, the base sloping downward, as is claimed.

OBJECTS AND ADVANTAGES

Accordingly, one object of the present invention is to provide a method and apparatus to conveniently and automatically position golf balls so they can be hit by a golf club in practice sessions by the golfer at driving ranges, at home or other locations as may be desired. Other objects are to provide a golf ball teeing device simple in design, efficient, reliable and one which is versatile and adaptable to a variety of golf ball dispensers which can be either fixed to the frame or removeable.

Another object and advantage of the present invention is to provide a teeing device which enables golfers to activate the entire operation with a golf club from their position or stance. The golfer depresses the activating pedestal allowing a single golf ball to be released and be placed upon a tee in one simple operation.

Another advantage of the invention is that it enables the golfer to concentrate without having to bend over or fumble around the ground for golf balls. This feature will be most helpful to all golfers and professionals who give golf lessons to others. Practice sessions on the driving range will be speeded up, thus increasing income for the owners.

Other objects and advantages include the following; to help a golfer develop a swing rhythm; to reduce tiredness; to protect the back; to eliminate stooping; to help improve golf scores on the course; and to encourage golfers to spend more time in practice sessions.

Further objects and advantages will become apparent from the ensuing description and drawings.

DRAWINGS

FIG. 3 is a view in perspective of the golf ball release and transfer assembly of FIG. 1.

FIG. 4 is a front view of the upper portion of the pivot arm assembly of FIG. 1.

FIG. 5 is a bottom end view of the upper portion of the pivot arm assembly of FIG. 1.

FIG. 6 is a side view of the upper portion of the pivot arm assembly of FIG. 1.

FIG. 7 is a front view of the pivot arm with pulley attached.

FIG. 8 is a top view of the positioning and centering device.

FIG. 9 is a side view of the positioning and centering device.

REFERENCE NUMERALS

Figure 1:
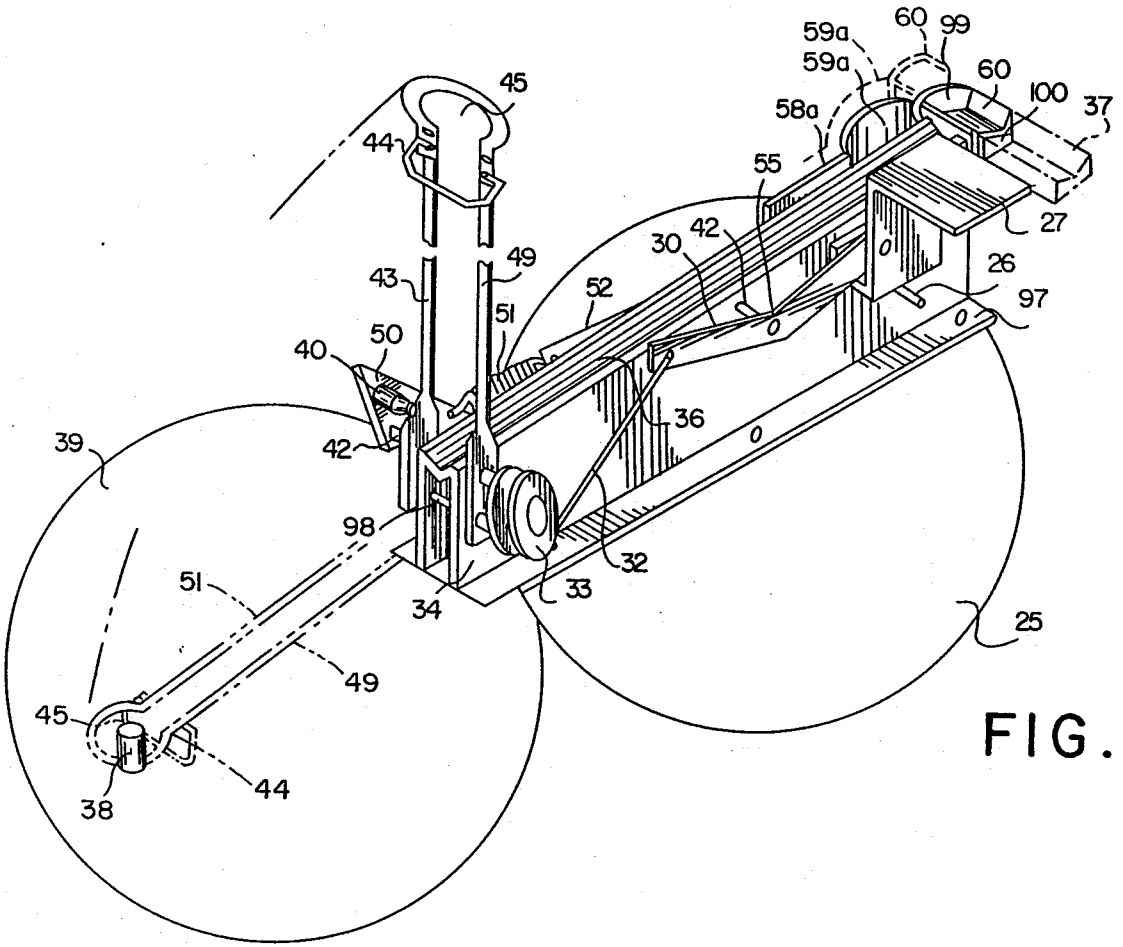
FIG. 1 is an illustration in perspective of the teeing device and mat utilizing hand operated control by the golfer.

9. Plastic strip
10. Golf ball stop
11. Spring
12. Golf ball guide channel or runner
13. Golf ball exit end of dispenser
14. Golf ball entry point into guide channel 15. Inner lining curve point at bottom of dispenser (broken lines)
16. Starting point of inner lining slope toward golf ball guide channel
17. One of two front legs supporting dispenser
18. One of two front legs supporting dispenser
19. One of two rear legs supporting dispenser
20. One of two rear legs supporting dispenser
21. Base or floor
22. Side walls of dispenser receptacle
23. Back wall of dispenser receptacle
24. Opening at top of dispenser receptacle or holder
25. Base
26. Restraining pin
27. Activating pedestal
30. Lever or levers
32. Pulley cable
33. Pulley
34. Frame
35. Spindle or shaft
36. Golf ball guide track
37. Golf ball holding receptacle (dispenser)
38. Tee
39. Base for tee
40. Grooved circular post
42. Spacers
43. Pivot arm
44. Positioning and centering device
45. Opening
49. Pivot arm
50. Connecting plate
51. Spring
52. Connecting plate
55. Spindle or shaft
57. Spindle or shaft
58. Side arms
59. Guard plate
60. Golf ball receiver
73. Circular wall of golf ball dispenser receptacle
74. Sidewall
75. Eliptical opening in golf ball dispenser receptacle
76. Rear leg support for golf ball dispenser
77. Front leg support for golf ball dispenser (shorter than rear leg to provide slope toward exit of golf ball dispenser)
78. Recess to base 21 to receive ends of circular rods 79
79. Circular rods or guide rails
80. Bracket holding golf ball stop 10
81. Platform, base or mat with tee 38
93. Nuts
94. Washers
95. Bushings or bearings
97. Flange
98. Connecting rod
99. Golf ball stop (upper)
100. Golf ball stop (lower)
101. Holes, slotted on each side of frame

DESCRIPTION

FIGS. 1 to 9

FIG. 1 shows the teeing device designed for use with a golf ball dispenser 37. Dispenser 37 is placed alongside a golf ball receiver 60, the dispenser 37 having slightly elevated descent, so as to allow a single line of golf balls to flow by gravity into receiver 60.

Figure 2:
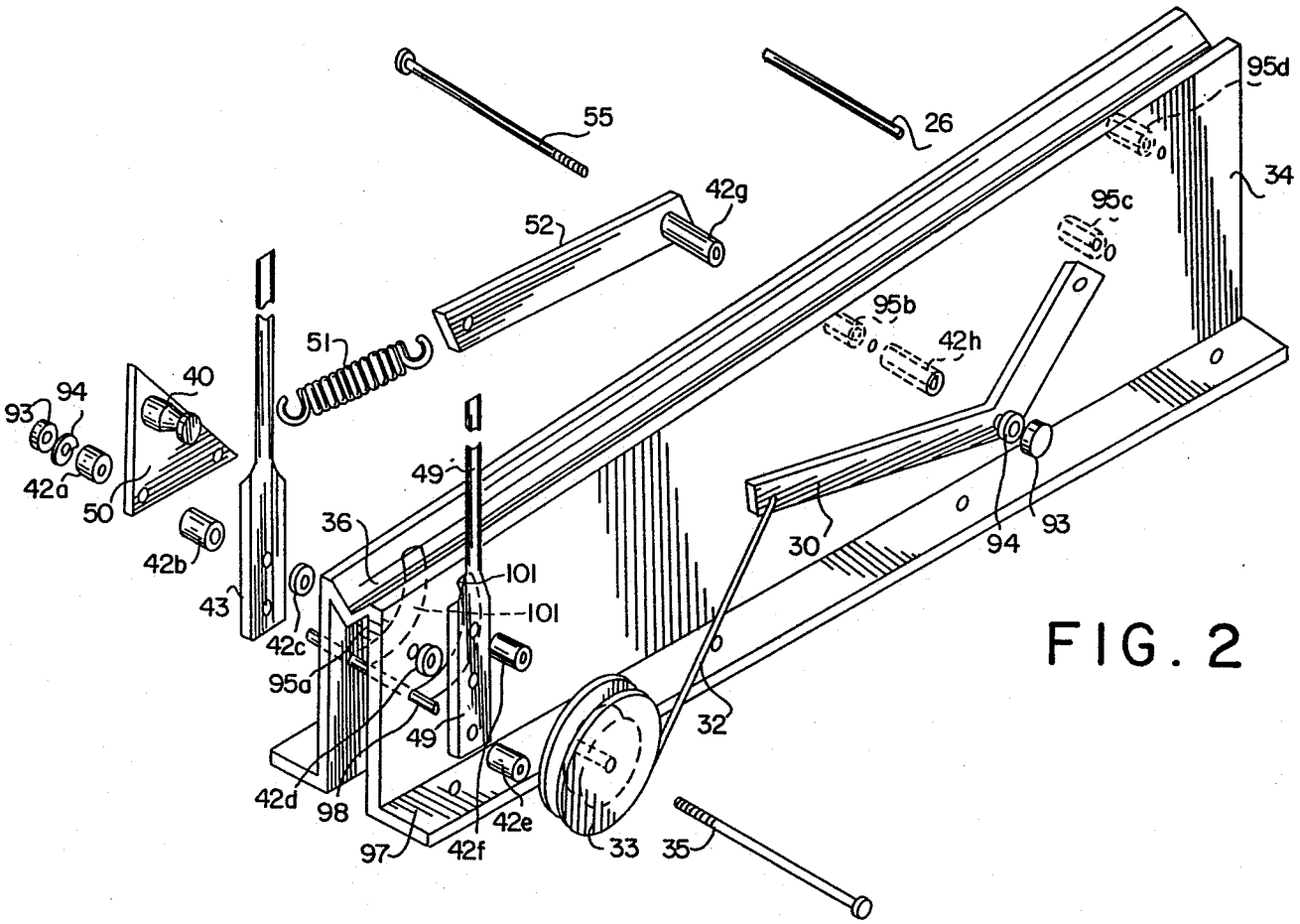
FIG. 2 is an exploded view in perspective of a portion of the parts used with the teeing device of FIG. 1.

The golf ball release and transfer assembly (FIGS. 1 and 3) consists of a spindle 57 which interconnects two side arms 58*a* and 58*b*, the spindle 57 being locatingly supported above a base 25 by a frame 34. The upper ends of these side arms are joined to golf ball receiver 60. Side arm 58*b* has an upwardly extending activating pedestal 27 which is the activating point for the golf ball release and transfer assembly as well as pivot arms 43 and 49 of a pulley-spindle assembly (FIGS. 1 and 2).

The golfer activates the teeing device by depressing upwardly extending activating pedestal 27. A restraining pin 26 limits movement of the golf ball release and transfer assembly, the pin 26 being spaced below the bottom of pedestel 27 is its rest position.

A spindle shaft 35 (FIGS. 1 and 2) extends through pivot arms 43 and 49, supporting framework 34, and connecting plate 50, the shaft 35 being locatingly supported by the frame 34. The shaft 35 protrudes a bushing or bearing 95, designated 95*a* in FIG. 2, that extends within the frame 34. Other bearings, designated 95*b*, 95*c*, and 95*d*, are similarly provided in the frame 34 for the shaft 55, the restraining pin 26, and the shaft 57. A spring 51 is attached to connecting plate 50 and is secured to a shaft 55. A grooved circular post, 40 is affixed to connecting plate 50 in such a manner that when acted upon by pivot arm 43, plate 50 provides the required tension upon spring 51.

A connecting rod 98 is positioned at the lower end of each of pivot arms 43 and 49 and extends through holes 101 in frame 34. Holes 101 are slotted, to insure alignment of the two pivot arms. In effect this limits movement of pivot arms 43 and 49 to approximately 90 degrees. Thus the arms 43 and 49 are operable between a retracted or raised position, indicated by the solid lines in FIG. 1, and an extended or lowered position, indicated by the dashed lines in FIG. 1. The lowered position of the arms 43 and 45 occurs when the activating pedestal 27 is rotated about the shaft 57 into contact with the restraining pin 26.

Mat 39 containing tee 38 (FIG. 1) has been separated from the teeing device. An opening in mat 39 is shaped to receive the front portion of the teeing device so that the mat and the teeing device can be interlocked into proper position. Tee 38 is so positioned that when the teeing device is placed within the opening at the outer end of the pivot arm assembly, tee 38 is properly aligned.

Spacers 42 (FIG. 2) are required at various points on the shafts in order to provide clearances for free movement of the component parts and insure satisfactory operation. In addition, a variety of washers, screws, bolts, nuts, rivets and other such items are required, but are not shown in the drawings for simplification of illustration. These items and their use are well known to those skilled in the art.

Positioning arm 44 (FIGS. 1, 8 and 9) allows the pivot arm assembly to be properly positioned above tee 38. A connecting plate 52 is positioned between spring 51 and shaft 55.

Most component parts of the teeing device will probably be of aluminum or plastic materials. The mats can be either ruberized or plastic construction as may be most suitable. The teeing device shown in FIG. 1 is approximately 22 inches (55.88 cm) long and approximately 6 inches (15.24 cm) wide at the widest point.

DESCRIPTION

Figure 10:
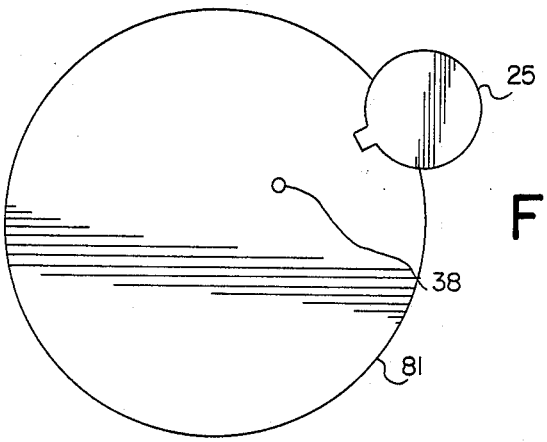
FIG. 10 is a top view of a standing platform or mat with tee.
Figure 11:
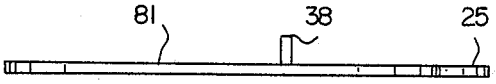
FIG. 11 is an end view of the standing platform or mat with tee.

FIGS. 10 and 11

FIGS. 10 and 11 illustrate a golfer's standing platform, base or mat. Tee 38 is so positioned that when the teeing device (illustrated by its base 25) is inserted into an opening at one end of the platform 81, the teeing device will be properly aligned as intended.

DESCRIPTION

FIGS. 12 to 15

FIGS. 12 to 15 show isometric, top, flattened-out, and a front end view respectively of a golf ball dispenser according to the invention. It comprises a trough-shaped holder 24 with side walls 22*a* and 22*b*, a back wall 23, and floor 21. Holder 24 is supported by legs 17, 18, 19 and 20. Plastic strip 9 is attached to spring 11, which in turn is affixed to golf ball guide channel 12. Golf ball stop 10 is attached to golf ball guide channel 12 in order to stop golf balls at a position opposite plastic strip 9. Inner linings 15*a* and 15*b* (indicated by broken lines) show the position of a curve at the bottom of holder 24, and also shows the gradually narrowed path that golf balls have to travel toward the opening provided by the golf ball guide channel 12 uo to exit end 13.

Sidewalls 22*a* and 22*b*, backwall 23, and floor 21 can be of any suitable material, such as wood, metal, or plastic. For left-handed golfers, plastic strip 9 is mounted on the opposite side from that shown in FIG. 12. Legs 17 and 18 are shorter than legs 19 and 20, thus causing the dispenser to slope downwardly toward exit end 13.

Figure 12:
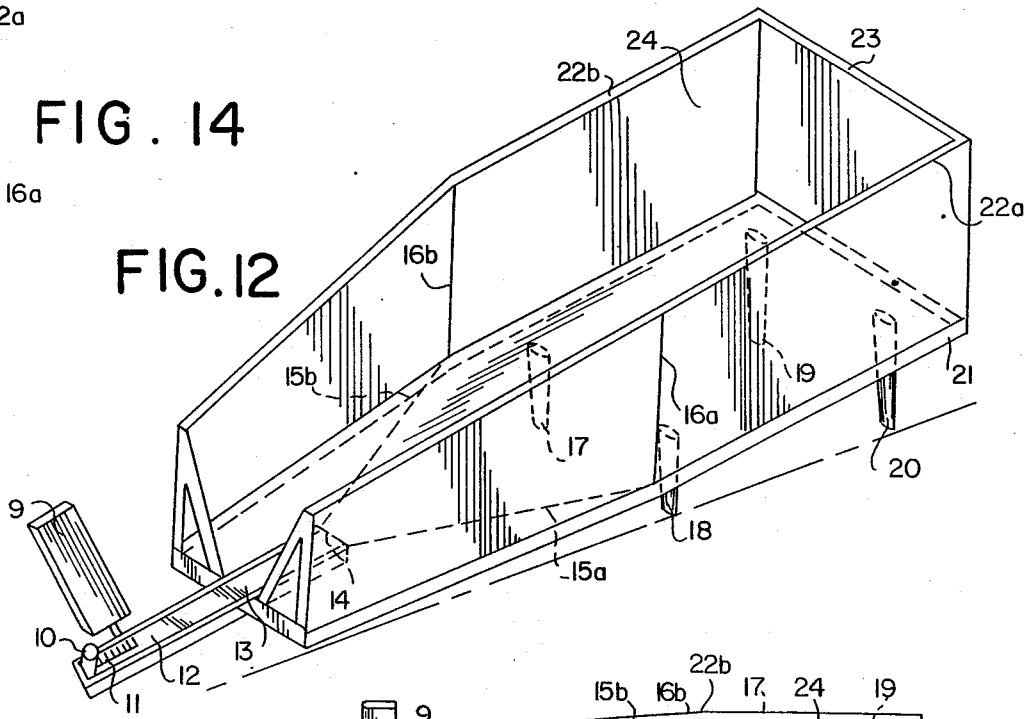
FIG. 12 is an illustration in perspective of the golf ball dispenser.
Figure 14:
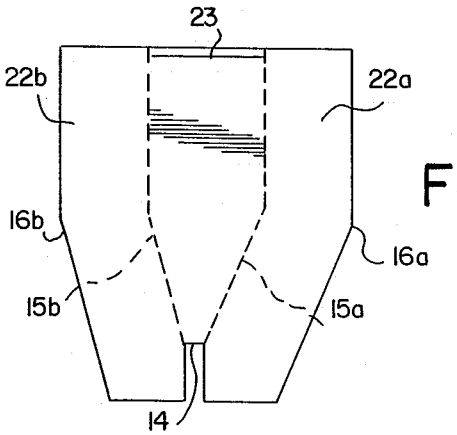
FIG. 14 shows the shape of the interior of the golf ball dispenser as if in a flattened position (excluding the back side) as opposed to its configuration as shown in FIG. 12.

FIG. 14 shows the shape of the interior of the golf ball dispenser as if in a flattened-out position (excluding back side 23) as opposed to its normal configuration shown in FIG. 12.

The golf ball dispenser shown in FIG. 12 is approximately 26 inches (66 cm) long, not including golf ball guide channel 12 which extends out 6 inches (15.2 cm). Holder 24 is 9 inches (22.9 cm) wide and 13 inches (33 cm) long up to starting points 16*a* and 16*b* of inner lining slope toward golf ball guide channel, beyond which the width of exit 13 is 5½ inches (14 cm). The top of holder 24 is 10½ inches (26.7 cm) above ground level in the example shown.

These measurements are somewhat dictated by the normal path of golf balls dumped into holder 24. However these measurements may be extended to provide increased capacity.

DESCRIPTION

FIG. 16

Figure 16:
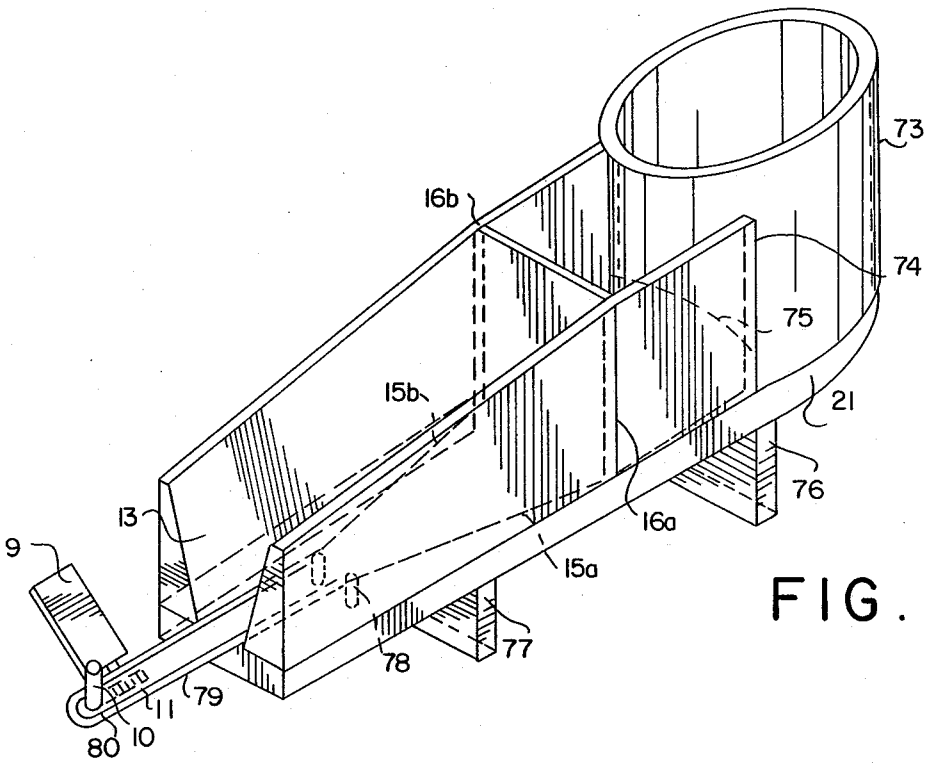
FIG. 16 is an illustration in perspective of the golf ball dispenser using a different design than that shown in FIG. 12.

FIG. 16 shows one example of the golf ball dispenser where a circular hopper or receptacle 73 is mounted on a base 21. Receptacle 73 has an elliptical opening 75 which allows golf balls to leave the receptacle into the area bounded by side walls 74, 16*a* and 16*b*. At points 16*a* and 16*b* the side walls 15*a* and 15*b* of the interior lining gradually narrow toward the opening at exit 13. This will cause golf balls to form a single file into and between circular rods or guide rails 79.

Elliptical opening 75 of receptacle 73 has a height above base 21 exceeding the diameter of two golf balls.

Plastic strip 9 is attached to spring 11 which is affixed to guide rails 79 by attachment to bracket 80. Golf ball stop 10 is attached to bracket 80. Leg 76 is longer than leg 77 so as to provide a downward slope toward exit end 13. A recess 78 is provided for each end of circular rod or guide rail 79 in order to secure the ends in their proper position during operation. Also the recesses make it possible to remove the entire unit, including plastic strip 9, golf ball stop 10, spring 11, guide rail 79, and bracket 80.

DESCRIPTION

FIGS. 17 to 20

FIGS. 17 to 20 show a side view, and end view, and two top views including one view when closed, of a golf ball dispenser according to the invention. It comprises a golf ball dispenser similar to that shown in FIG. 1 except that trough-shaped holder 24 has been separated into two sections. Section A has upstanding side walls 22*a* and 22*b* extending up from a base 21*a* from opposite sides of base 21*a*, one portion of each side wall 22 facing a corresponding portion of the other side wall 22.

Section B has a portion of each of its side walls 22*a* and 22*b* facing a corresponding other portion of the other side wall 22*a* and 22*b*, and gradually converge closer together to the other side wall 22*a* and 22*b* at the exit end 13. Both section A and section B are joined together by a hinge (or hinges) 85 so that section B can be inverted or placed on top of section A for portability.

Brackets 83 have slots which are provided for panels (not shown). These panels are inserted into brackets 83 when the two sections A and B are closed. This will provide a closed container for golf balls when they are transported. By the addition of a handle and security latches (not shown), the convenience of portability has been provided.

Figure 19:
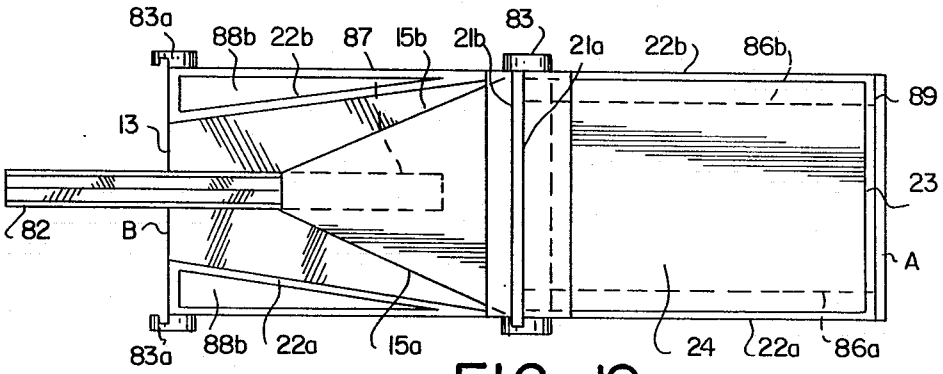
FIG. 19 shows a top view.
Figure 17:
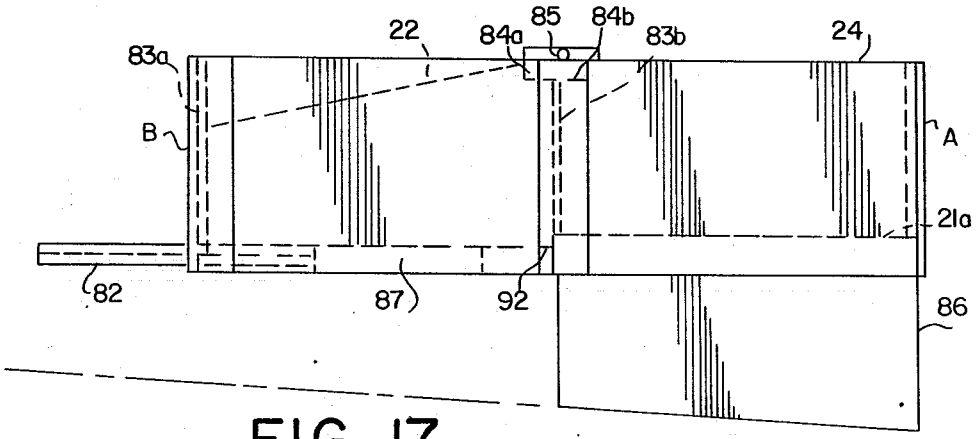
FIG. 17 shows a side view.
Figure 20:
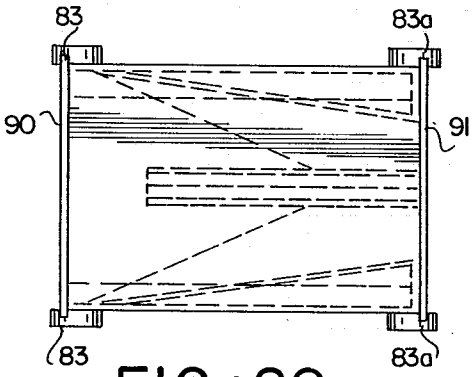
FIG. 20 shows a top view when closed of an alternate design which can be used for providing a portable package of the golf ball dispenser.
Figure 18:
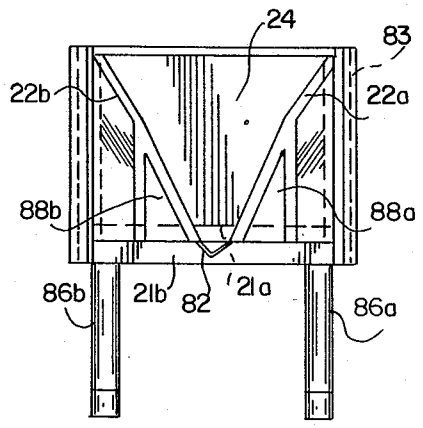
FIG. 18 shows and end view.

This example has a provision for golf ball guide channel 82 to be retractable into a recess 87 within base 92. The level of base 92 is below base 21*a* so as to provide additional momentum for golf balls leaving section A into section B. Frame 84*a* supports hinge (or hinges) 85, as does frame 84*b*. Wedge shaped legs 86 provide proper slope. Spaces 88*a* and 88*b* are between the inner linings and outer walls. Ledge 89 provided for enclosure panels (not shown). FIG. 19 shows the position for placement of enclosure panels 90 and 91 when section A is closed and section B is inverted over section A.

OPERATION OF GOLF BALL TEEING DEVICE

A single line of golf balls passes onto a golf ball release and transfer assembly of the teeing device from a golf ball dispenser 37. Each golf ball is transferred from the golf ball release and transfer assembly to a fixed tee as follows:

The golfer activates the teeing device by using his or her golf club to depress the upwardly extending activating pedestal 27. Side arm 58*b* is connected to activating pedestal 27 and is interconnected to lever 30. Cable 32 and pulley 33 are affixed to spindle shaft 35, which is attached to pivot arm assembly 43–49. Pivot arm assembly 43–49 has a golf ball centering device with a hole 45 at the top end to receive the golf ball. Pivot arm assembly moves approximately 90 degrees from an upright position to a position centered over tee 38.

When activating pedestal 27 is activated by the golfer, golf ball receiver 60 moves upward rapidly in a sudden action, thereby propelling a golf ball upward and in the direction of golf ball guide track 36 between guard plates 59*a* and 59*b*. Another golf ball automatically falls into position on golf ball receiver 60 from the golf ball holding receptacle 37 which is supplied by the golf ball dispenser.

Golf ball stop 99 allows only one golf ball to be positioned on receiver 60. Other golf balls from the dispenser do not move onto receiver 60 when activating pedestal 27 returns to its prior or normal position. This is accomplished by golf ball stop 100 which prevents other golf balls from moving. When golf ball stop 100 returns to its normal position, another golf ball advances into receiver 60.

Activating pedestal 27 is held down by the golfer while the golf ball approaches the end of guide channel 36. At this time, the golf ball continues its downward course between pivot arms 43 and 49. Since the spacing between pivot arms 43 and 49 is somewhat less than the diameter of a golf ball, the golf ball is supported on top of and between pivot arms 43 and 49, and thence continues by gravity to center itself over opening 45 which has a diameter larger than a golf ball. Thus the golf ball is centered over and drops onto tee 38. Upon release of activating pedestal 27, the pivot arm assembly returns to an upright or vertical position, this being accomplished by action of spring 51.

OPERATION OF GOLF BALL DISPENSER

A multitude of golf balls, such as a bucket of balls normally found at a golf driving range, are dumped into top opening of holder 24 of the dispenser. The dispenser (FIGS. 12, 16 or 17) is designed in such a manner that balls within form a pattern which allows a single line of golf balls to roll out exit end 13 onto runner 12 or 79 until the lead golf ball strikes ball stop 10, and at that point the flow of balls ceases. The dispenser is now ready to be used by the golfer for chipping, pitching, putting or driving, as may be desired.

Figure 13:
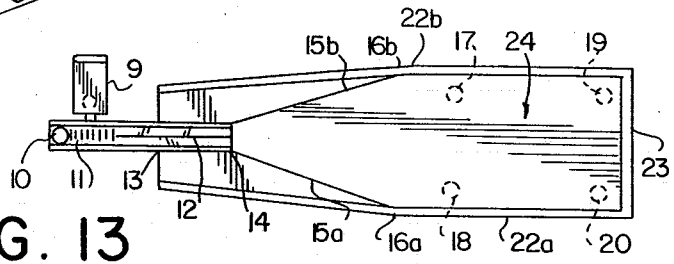
FIG. 13 is a top view of the golf ball dispenser.
Figure 15:
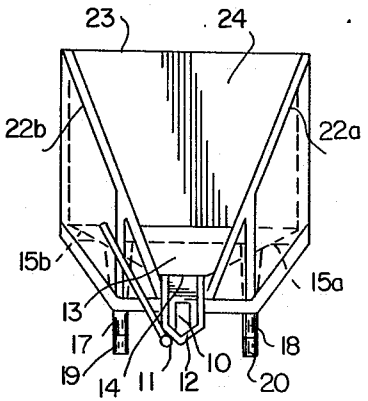
FIG. 15 is an end view of the golf ball dispenser (exit end).

The golfer strikes plastic strip 9 with his or her golf club. This pushes a single golf ball onto ground or other surface where the ball can be hit. Alternativelt the ball can be placed onto a tee if desired for practice sessions. It should be noted that the dispenser in FIGS. 12, 13 and 15 is designed for use with a teeing device, all units described being a part of this invention.

As noted, dispenser is adaptable to supply golf balls to a teeing device. When the dispenser is used in combination with the teeing device, plastic strip 9 and golf ball stop 10 are not required.

SUMMARY, SCOPE AND RAMIFICATIONS

Thus the reader will see that this invention provides a method and apparatus for conveniently and automatically positioning golf balls on a tee so they can be hit by a golf club in the hands of a golfer. This is accomplished by enabling the golfer to activate the entire operation with his or her golf club from his position or stance.

The teeing device is simple in design and quite versatile in that the unit is small and adaptable to a variety of golf ball dispensers which can be either fixed to the frame or removeable.

The teeing device can be used with two different sizes of mats with fixed tees. Both of these mats have an opening which allows the teeing device to be so positioned within the opening at the outer end of the pivot arm assembly that the tee is properly aligned. One of the mats is small for portability. The other is much larger so as to enable the golfer to stand upon the mat while hitting golf balls in practice sessions.

The golf ball dispenser is simple in design, only requiring that the golfer dump a multitude of golf balls into holder, and from then on, he or she need merely provide a gentle tap to a plastic strip in order to have a golf ball at the point of play. Efficiency and reliability with less maintenance is obtained by use of fewer parts. Fewer back pains are suffered from bending or stooping than with the use of prior art devices. Many advantages are provided for the golf ball dispenser in addition to those described above; namely, it has light weight and portability by virtue of its fabrication in plastic, thus reducing the cost of manufacturing and lowering the selling price which increases its availability to the average golfer. Also its portability encourages golfers to spend more time in practice sessions with less effort, thus enabling the golfer to achieve lower scores on the golf course.

Other embodiments can employ a circular configuration for holder 24 instead of rectangular; an entirely different design in shape or configuration such as will be possible with the use of plastics; the legs can be rigid or detachable, or adjustable as to height; and circular rods can be used for runners, guide rails or tracks, or other means which will occur to those skilled in the art upon reading disclosure set forth hereinbefore and the drawings related thereto.

While this description contains many specificities, these should not be construed as limitations on the scope of the invention, but rather as an exemplification of one preferred embodiment thereof. Other embodiments can be used for activation of the teeing device, such as a foot pedal, a remote control, or electronic or other means, Further ramifications will occur to those skilled in the art upon reading the above description and studying the drawings.

Accordingly, the scope of our invention should be determined not by the embodiment illustrated, but by the appended claims and their legal equivalents.

We claim:

1. A golf ball teeing apparatus, comprising:

(a) a frame structure having a golf ball track thereon, said track being linear and sloping between upper and lower ends thereof;

(b) receiver means, separate and in addition to said track, for receiving a golf ball from a dispenser, said receiver being movably attached to said frame and positioned at said upper end of said track and arranged, upon actuation thereof, to release a golf ball onto said track;

(c) an actuator member mounted on said frame structure and movable between rest and active positions;

(d) means coupled to said actuator member for releasing said golf ball from said receiver means onto said upper end of said track in response to movement of said actuator member from its rest to its actuated position, thereby permitting said golf ball to roll down said track;

(e) an arm structure having first and second ends and movably mounted relative to said frame structure, said arm structure being operable between extended and retracted positions in response to movement of said actuator member from its rest to its active position, said arm structure in said extended position being positioned below said lower end of said track, being downwardly sloping, and forming a continuation of said lower end of said track, said first end of said arm structure being operatively and directly coupled to said lower end of said track; and (f) a centering member at said second end of said arm structure for receiving said golf ball from said arm structure when it forms said continuation of said track and releasing said golf ball in a predetermined horizontal alignment relative to said frame structure for depositing said golf ball onto a tee therefor.

2. The apparatus of claim 1 further comprising:

(a) a spring operatively connected between the frame structure and said arm structure for returning said arm structure to said retracted position after being activated to a near horizontal position for placing a golf ball upon a tee;

(b) said means coupled to said actuator member comprising a pair of side arms pivotally connected to said frame structure on opposite sides of said track, (c) said receiver means comprising a trough-shaped golf ball receiving receptacle affixed to at least one of said side arms proximate one end thereof; and (d) said actuator member including an upstanding pedestal for enabling a golfer to actuate said apparatus.

3. The apparatus of claim 2 further comprising:

(a) a lever assembly structure pivotally connected to the frame assembly, said lever assembly being operably connected to one of said side arms;

(b) a pulley cable operably connected between said arm structure and said lever assembly for lowering said arm structure to said extended position in response to movement of said pedestal; and (c) a restraining member rigidly connected to said frame for restricting movement of said upstanding pedestal and side arms, thereby to cause said trough-shaped golf ball receiving receptacle to move upward to a sudden stop for propelling a golf ball upwardly from said receptacle in the direction of said golf ball track affixed to said frame.

4. The apparatus of claim 1 wherein said receiver means comprises a receiver member, and a golf ball stop affixed to said receiver member and extending below said receiver member in line with the dispenser means, said stop including means for permitting no more than a single golf ball to move from said dispenser means upon each activation of said apparatus.

5. The apparatus of claim 1 further comprising a mat, and a base opening for receiving and registering a base portion of frame structure, whereby, when said arm structure is in said extended position, golf balls will drop through an opening at said outer end of said arm structure onto said mat.

6. The apparatus of claim 5 further comprising a tee member affixed to said mat for locatably supporting a golf ball, said tee being positioned so that when said base portion of frame structure locatingly engages the opening in said mat, said tee will be properly aligned with said opening at said outer end of said arm structure in its extended position, whereby a golfer standing on said mat will be able to hit a golf ball when the ball drops onto said tee from said arm structure of said apparatus.

7. The apparatus of claim 5 further comprising a tee affixed to said mat, said tee being positioned so that when said frame structure in registration with said opening in the mat, said tee will be properly aligned with said arm structure in its extended position, whereby a golfer will be able to hit a golf ball when said ball drops onto said tee from said arm structure of said teeing apparatus.

* * * * *